United States Patent [19]

Crowson et al.

[11] Patent Number: 5,042,679

[45] Date of Patent: Aug. 27, 1991

[54] CONTAINER FOR STORAGE OF RADIOACTIVE MATERIALS

[75] Inventors: Francis R. Crowson, Mount Airy; Richard J. DiSalvo, Baltimore, both of Md.

[73] Assignee: RSO, Inc., Laurel, Md.

[21] Appl. No.: 454,383

[22] Filed: Dec. 21, 1989

[51] Int. Cl.[5] ..... B65D 51/18; G21F 5/00

[52] U.S. Cl. ..... 220/256; 220/315; 220/327; 220/352; 215/263; 215/355; 250/506.1; 376/272; 411/5; 411/910

[58] Field of Search ..... 220/256, 288, 315, 320, 220/321, 327, 328, 352, 353, 15; 376/272; 250/506.1, 507.1; 215/263, 355, 364; 411/3, 4, 5, 910

[56] References Cited

U.S. PATENT DOCUMENTS

| | | | |
|---|---|---|---|
| 1,348,915 | 8/1920 | Winslow | 220/256 |
| 1,431,911 | 10/1922 | Jones . | |
| 1,647,321 | 11/1927 | Thurstensen | 220/284 |
| 1,702,878 | 5/1927 | Mersfelder et al. . | |
| 1,795,780 | 3/1931 | Kiernan | 266/171 |
| 2,611,507 | 1/1952 | Wayman . | |
| 2,844,363 | 10/1955 | Clark . | |
| 3,005,105 | 10/1961 | Lusk | 250/506.1 |
| 3,498,174 | 3/1970 | Schuster et al. | 411/5 |
| 3,978,761 | 9/1976 | Sosinski | 411/5 |
| 4,082,130 | 4/1978 | Rech | 151/23 |
| 4,109,820 | 8/1978 | Stifano . | |
| 4,582,668 | 4/1986 | Mallory et al. | 376/203 |
| 4,594,214 | 6/1986 | Popp et al. | 376/272 |
| 4,673,813 | 6/1987 | Sanchez . | |
| 4,709,831 | 12/1987 | Coplan . | |
| 4,711,365 | 12/1987 | Fomby . | |
| 4,738,388 | 1/1988 | Bienek et al. . | |
| 4,754,894 | 7/1988 | Simon et al. . | |
| 4,756,852 | 7/1988 | Temus | 252/633 |
| 4,883,637 | 11/1989 | McDaniels, Jr. | 376/272 |

FOREIGN PATENT DOCUMENTS

| | | | |
|---|---|---|---|
| 2625142 | 6/1976 | Fed. Rep. of Germany | 411/3 |

*Primary Examiner*—Stephen Marcus
*Assistant Examiner*—Stephen K. Cronin
*Attorney, Agent, or Firm*—Vorys, Sater, Seymour & Pease

[57] ABSTRACT

Provision is made for a container which stores and shields radioactive material. Included in the container is an enclosure defining a hollow chamber in which radioactive material is storable. A closure assembly cooperates with the enclosure in such a manner that an internal plug thereof effects a preselected gas-impervious sealing engagement. The closure assembly includes a lug which is rotatable to urge the assembly into sealing engagement and which torsionally fails following achievement of the desired sealing engagement of the closure plug to thereby prevent the lug from being subsequently used to open the container. The container and closure members provides desired radioactive shielding.

11 Claims, 1 Drawing Sheet

CONTAINER FOR STORAGE OF RADIOACTIVE MATERIALS

BACKGROUND OF THE INVENTION

The present invention relates generally to containers for storing hazardous substances. More specifically, the invention relates to containers which store radioactive substances which are easily and effectively sealable while being able to resist access to the substances therein.

With the widespread use of radioactive substances in the medical and scientific fields there are frequent requirements to package, store and transport them between facilities and to repositories. Radioactive substances, of course, present significant hazardous conditions and they must be safely contained and transported. The physical transfer of the radioactive materials involves a rigorous packaging so as to preclude spread of loose radiocontaminants and/or unauthorized tampering with the material. Given the nature of the hazards associated with radioactive materials, the government has established regulations governing the construction and transportation of containers. The regulations, such as 10 CFR 20, establish exacting methods for human protection which often require expensive and time consuming packaging procedures. Compliance with these requirements is, of course, costly.

However, certain government regulations provide somewhat less stringent and costly packaging criteria for the encapsulation of the radioactive material; see, for example, 10 CFR 70 and 49 CFR 173.403(z). These criteria relate to containing small quantities of radioactive materials which must be so encapsulated that there cannot be emission or spread of radioparticulate contamination. To qualify for such special status, the radioactive materials cannot be directly accessed without destruction of the container. Moreover, government regulations such as those in 49 CFR 173.403 also specify that the container must be empirically provable as: impervious to gas influence or effluence at one atmosphere pressure; being able to retain its integrity after ten minutes subjugation to a temperature of 1472° Fahrenheit; being able to withstand repeated drops onto a unyielding surface from a preselected height; and, having unyielding integrity after an iron bar of preselected weight free-falls from a preselected height onto each of the container's surfaces. When at least these special status requirements are satisfied, small amounts of radioactive materials are permitted to be stored and transferred by and between users with much less costly packaging. It is, therefore, highly desirable to qualify for such special status.

Numerous devices have been used for packaging materials. Not all are, however, usable for successfully sealing radioactive materials which meet exacting government guidelines. For example, U.S. Pat. Nos. 1,702,878 and 1,431,911 describe enclosures incorporating pipe thread or similarly tapered thread binding in both pitch and depth of thread, to make a tight seal. Tapered seals have not been found to be leak-tight when subjected to rigorous government standards required for the transportation of radioactive materials. For instance, it has been determined that conventional tapered threads are not leak-tight to helium after heating to 1472° F. It was concluded that any threaded connection would leave a labyrinthian passage for gas leakage after heating. Accordingly, enclosures such as those noted above and described in U.S. Pat. Nos. 2,611,507; 4,109,820 and 4,711,365 were not considered starting points for providing a capsule or container which satisfies the government standards for the noted special form containers.

Other similar type closures for sealing material use, for example, solder as a thread sealant. However, the use of solder as a thread sealant precludes any container so sealed from retaining leak tightness to the helium after heating to 1472° F. This is because all normal solder that is compatible with the metals of these constructions will melt and flow from the joint at much lower temperatures than required by the government. Moreover, known prior art patents do not disclose an internal sealant plug in conjunction with a machined threaded enclosure member. U.S. Pat. No. 4,754,894 and U.S. Pat. No. 4,738,388 both describe closures for massive structures for large quantities of radioactive or hazardous substances. The types of container constructions disclosed, however, would not satisfy conditions required by the government for the noted special form status.

SUMMARY OF THE INVENTION

According to the present invention there is provided an improved container which overcomes disadvantages of the prior art in protecting against radioactive leakage. Moreover, the container provided is capable of meeting exacting government standards as well as provides for ease of encapsulation.

In this regard, there is provided an enclosure device defining a hollow chamber for storably receiving therein hazardous materials and for defining an open end portion having first threaded means associated therewith, and a sealing portion located inwardly of the first threaded means. Included is closure means having second threaded means thereon for threaded cooperation with the first threaded means and an internal closure plug means for effecting a preselected gas-impervious sealing engagement with the sealing portion of the enclosure means.

In an illustrated embodiment, the closure means is provided with a frangible projection and is rotatable by a tool so that the second threaded means upon tightening relative to the first threaded means urges the closure plug means, with predetermined force, into the preselected sealing engagement before the projection breaks. There is then no external surface which can be used to open the container. The container is constructed of shielding material which inhibits radioactive leakage and possess sufficient strength for satisfying predetermined government strength requirements.

In an illustrated embodiment the closure plug means is made of a dissimilar metallic material to the sealing portion of the enclosure means so that a molecular adhesion between the sealing portion and the plug means can enhance the noted sealing action.

In another illustrated embodiment the frangible projection has a cross-sectional area which fails at a torque value which corresponds precisely to the predetermined force required for effecting the noted sealing engagement.

Among the other objects and features of the present invention are: the provision of an improved container for storing and transporting hazardous waste materials; the provision of a container as noted wherein the hazardous waste material is radioactive and is quickly, easily and reliably sealed; the provision of a container, as noted, wherein the radioactive material cannot be accessed without destroying the container; the provision of a container which satisfies government standards regarding the sealing of radioactive materials; the provision of a container which insures proper sealing upon mechanical failure of a projection connected thereto; and the provision of an improved container of the above note kind which achieves the noted advantages in a relatively simple and inexpensive manner.

Still other objects and further scope of applicability of the present invention will become apparent from the detailed description to follow when taken in conjunction with the accompanying drawings in which like parts are designated by like reference numerals throughout the views.

DETAILED DESCRIPTION

Figure 2:
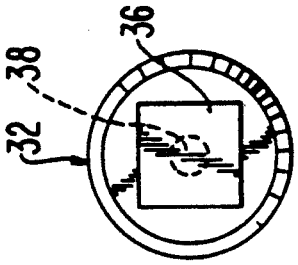
FIG. 2 is a plan view of the closure member of the present invention.
Figure 1:
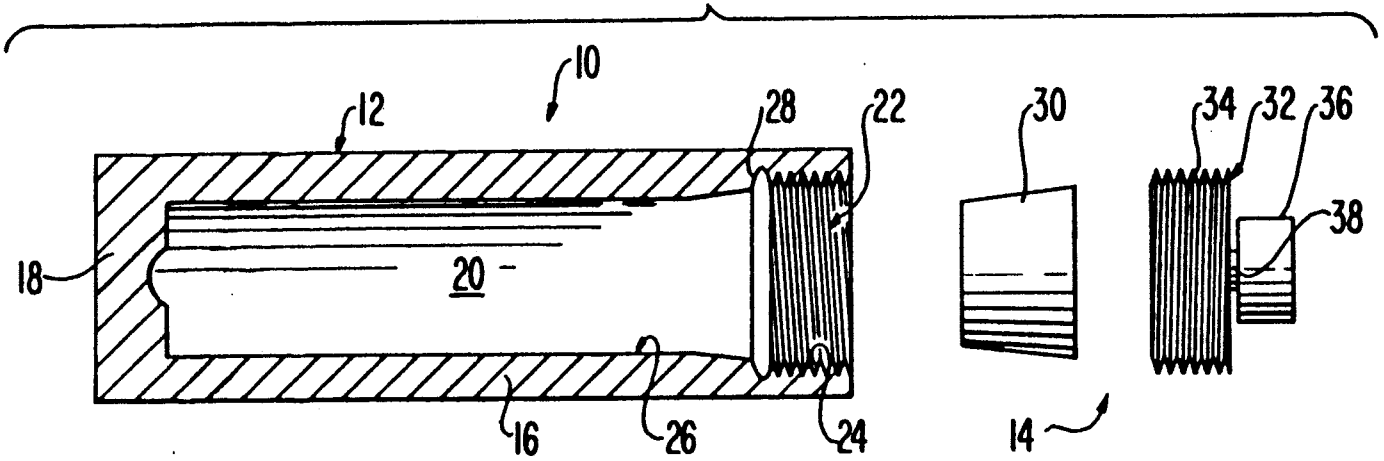
FIG. 1 is an exploded view of the improved container of the present invention with certain components thereof in cross-section.

Reference is made to FIGS. 1 and 2 for showing an improved radioactive capsule or container 10 made in accordance with the provisions of the present invention. In the present embodiment, the container 10 is comprised of a machined, one-piece enclosure body 12 and a closure assembly 14. Initial reference is made to the enclosure body 12 and is seen to include an integral cylinder wall 16 which can be made of a wide variety of materials that serve to shield against radiation leakage. Given the kind of sealing intended by the present invention, stainless steel may be used having a wall thickness of about, for example, 1 cm. Other suitable materials and thicknesses can be selected to satisfy desired radiation and strength requirements such as described in 10 CFR 70 and 49 CFR 173.403(z). The enclosure body 12 is also provided with a base 18 that defines a chamber 20 which is sized to removably receive therein radioactive materials (not shown) or other hazardous substances. The enclosure body 12 also defines an open end portion 22 which removably receives or cooperates with the closure assembly 14. An internally machine threaded segment 24 is formed adjacent the open end portion 22 for threaded cooperation with the closure assembly 14. A tapered sealing portion 26 is formed intermediate the threaded segment 24 and the chamber 20. The threaded segment 24 has an undercut portion 28 which allows travel of the closure assembly 14 to the full depth of the open end portion 22. Accordingly, the closure assembly 14 will not have the threaded portion thereof protrude beyond the lip of the open end portion 22. This assists in preventing the opening of the container through any viable mechanism short of willfully, physically destroying the entire container.

Reference is now made to the closure assembly 14. The closure assembly 14 includes a separate, internal plug segment or means 30 which is turned to, preferably, the same taper and surface finish as the sealing portion 26. In this embodiment, the plug 30 must be a separate member because if it is formed integrally with the remainder of the closure assembly 14 retrograde vibratory action of the cap 32 may cause compromise of the gas-type seal. The plug 30 can be made of the same or, preferably, dissimilar material from that of the sealing portion 26. The closure member 14 includes a cap 32 having external threaded portion 34 which threadedly cooperates with the threads formed on the threaded segment 24. The complementary and mating sealing portion 26 and plug 30, engage under a preselected force, when tightened under the desired torque on the cap 32. The preselected force is selected to be effective to provide a gas-impervious sealing engagement therebetween which prevents the emanation of radioactive gas from the chamber 20. For example, the predetermined force for achieving sealing can be about 3000 psi and the torque applied to the cap 32 can be 140 in.-lbs.

In this embodiment, at least the plug 30 of the closure assembly 14 is made of a steel, which is slightly dissimilar in terms of its chemical composition, to that of the steel used for the sealing portion for reasons which will be mentioned. For example, the steel of the sealing portion 26 can be ASTM type 303 stainless steel and the steel of the plug 30 can be ASTM type 316 stainless steel.

Because the tapered plug 30 and the tapered sealing portion 26 are made of chemically dissimilar steels, there can be a galvanic-like or so-called ming-fang seizure of closely fitted and finely machined surfaces. Specifically, when smooth steel surfaces are subjected to high pressures, such as those which are sufficient to achieve the noted gas-impervious seal there is a molecular adhesion between the two surfaces. Such molecular adhesion serves to even further enhance the sealing engagement of the plug 30 to the enclosure body 12. The degree of fineness of the mating surfaces and the degree of dissimilarity in the mating materials should be such that the noted galvanic-like seizure or molecular adhesion of the materials can be achieved. For instance, the steel surfaces can have a fineness value of about RMS 32. The molecular adhesion assists in preventing the opening of the container 10.

Generally axially protruding from the cap 32 is a frangible projection lug 36. The projection lug 36 may be rotated with sufficient torsional force so that the cap 32 can be tightened relative to the enclosure body 12. Accordingly, the plug 30 is forced inwardly against the tapered sealing surface 26 with sufficient force to effect the gas-tight seal. The seal is impervious to the inward or outward leakage of, for example, helium gas at several atmospheres differential relative to ambient after being heated to a preselected temperature, such as 1472° F., for a preselected time, such as approximately ten (10) minutes.

The frangible projection lug 36 has a reduced diameter portion 38. The reduced portion 38 has a cross-sectional area equivalent to the amount of metal which is known to fail under torsional stress that brings about the noted pressure for effecting the gas-tight seal. Preferably, the torque upon which the portion 38 will fail is linked precisely to the achievement of the predetermined force value associated with bringing about the seal. Of course, failure of the portion 38 need not occur precisely when the preselected force is achieved, but can fail subsequently to the value being met. Upon failure of the lug 36 there is no external surface which can be used to rotatably open the closure assembly 14. This failure of the lug 36 assists in preventing the opening of the container 10 through any viable mechanism short of willfully, physically destroying the entire container.

Consequently, the container made in accordance with the present invention can satisfy the requirements for a special status container which requirements are noted above.

Since certain changes may be made to the above-described device without departing from the scope of the invention herein involved, it is intended that all matter contained in the description or shown in the accompanying drawings shall be interpreted as illustrative and not in a limiting sense.

What is claimed is:

1. A container for storing and transporting hazardous materials comprising:

an enclosure means defining a hollow chamber for storably receiving therein the hazardous materials and defining an open end portion having a first threaded portion and a sealing portion located inwardly of said first threaded portion;

a closure means having a second threaded portion thereon for threaded cooperation with aid first threaded portion and an internal closure plug means for effecting a preselected gas-impervious sealing engagement with said sealing portion of said enclosure means; and said sealing portion and said plug means are made of dissimilar metallic materials relative to each other and having preselected smooth surfaces for effecting molecular adhesion therebetween when said sealing engagement is achieved.

2. A container for storing and transporting hazardous materials comprising:

an enclosure means defining a hollow chamber for storably receiving therein the hazardous materials and defining an open end portion having a first threaded portion and a sealing portion located inwardly of said first threaded portion;

a closure means having a second threaded portion thereon for threaded cooperation with said first threaded portion and an internal closure plug means for effecting a preselected gas-impervious sealing engagement with said sealing portion of said enclosure means;

said sealing portion and said plug means are made of dissimilar metallic materials relative to each other and having preselected smooth surfaces for effecting molecular adhesion therebetween when said sealing engagement is achieved; and said materials of said plug means and said sealing portion are made of dissimilar steel compositions.

3. A non-reusable container for permanently storing and transporting hazardous materials comprising:

an enclosure means defining a hollow chamber for storably receiving therein the hazardous materials and defining an open end portion having a first threaded portion and a sealing portion located inwardly of said first threaded portion;

a non-removable closure means having a second threaded portion thereon for threaded cooperation with said first threaded portion and an internal closure plug means for effecting a preselected gas-impervious sealing engagement with said sealing portion of said enclosure means; and said non-removable closure means including a frangible projection means projecting outwardly therefrom and in a general direction opposed to that of said plug means for breaking off in response to at least a predetermined rotational force, said frangible projection means being rotatable by a tool so that said second threaded portion, upon tightening relative to the first threaded portion, urges said plug means, with said predetermined sealing force, into said sealing engagement with said sealing portion at least before said frangible projection means breaks-off, so that there is no rotatable external surface on said non-removable closure means, whereby the combination of said non-removable closure means having no external rotatable surface and said predetermined sealing force are effective so that access to the hazardous material can only be obtained by destroying said container.

4. The non-reusable container of claim 3 wherein:

said enclosure means and non-removable closure means are constructed of preselected materials which would inhibit undesired leakage of radioactive material and which possess predetermined strength.

5. The non-reusable container of claim 3 wherein:

said frangible projection means is sized and shaped to be rotated by a tool so a to fail torsionally upon being rotated after the achievement of said sealing engagement.

6. The non-reusable container of claim 3 wherein:

said sealing portion and said plug means are made of dissimilar metallic materials relative to each other and have preselected smooth surfaces for effecting molecular adhesion therebetween when said sealing engagement is achieved.

7. The non-reusable container of claim 6 wherein:

said material of said plug means and said sealing portion are made of dissimilar steel compositions.

8. The non-reusable container of claim 5 wherein:

said frangible projection has a cross-sectional area which torsionally fails generally precisely upon said sealing engagement being achieved.

9. The non-reusable container of claim 3 wherein:

said enclosure means is sized so as to allow said non-removable closure means, upon being tightened, not to protrude from said enclosure means to thereby inhibit removal of said non-removable closure means.

10. The non-reusable container of claim 4 wherein:

said sealing engagement can be maintained as to prevent gas influence or effluence of helium at one atmosphere pressure; retains its integrity after subjugation to a temperature of 1472° Fahrenheit; withstands repeated drops onto an unyielding surface from a preselected height and having unyielding integrity after an iron bar of preselected weight free-falls from a preselected height onto each surface of said container.

11. A method of closing a container for permanently storing and transporting hazardous materials comprising the steps of:

providing an enclosure means defining a hollow chamber for permanently storing hazardous materials and defining an open end portion having a first threaded portion and a sealing portion located inwardly of the first threaded portion;

providing a closure means having a second threaded portion thereon for threaded cooperation with the first threaded portion and an internal closure plug means for effecting a preselected gas-impervious sealing and molecular adhesion engagement with the sealing portion of the enclosure means;

providing the closure means with frangible projection means rotatable by a tool for breaking off in response to at least a predetermined rotational force so that the second threaded portion upon tightening relative to the first threaded portion urges the plug means, with the predetermined force, into permanent sealing engagement with the sealing portion of the enclosure means; providing the frangible projection means with a cross-sectional area which insures breaking-off of the frangible projection means upon the threaded means achieving the predetermined force sufficient to achieve a preselected impervious sealing engagement; and tightening the frangible means with a tool until the frangible means breaks-off without any rotatable external portions, thereby indicating that the predetermined impervious sealing engagement is achieved and said predetermined force brought about by said tightening step also effects molecular adhesion between the plug means and the sealing portion.

* * * * *